United States Patent [19]

Reitz et al.

[11] 4,058,449

[45] Nov. 15, 1977

[54] HYDROCRACKING PROCESS

[75] Inventors: Ortwin Reitz, Heidelberg, Germany; Jean-Pierre Rétoret, Saint Germain en Laye, France

[73] Assignees: Institut Francais du Petrole; BASF Aktiengesellschaft, both of Rueil-Malmaison, France

[21] Appl. No.: 688,522

[22] Filed: May 21, 1976

[30] Foreign Application Priority Data

| | | |
|---|---|---|
| May 21, 1975 | France | 75.16048 |
| May 21, 1975 | France | 75.16047 |
| Dec. 30, 1975 | France | 75.40390 |

[51] Int. Cl.[2] ..... C10G 13/02

[52] U.S. Cl. ..... 208/59; 208/103; 208/105

[58] Field of Search ..... 208/59, 103, 105

[56] References Cited

U.S. PATENT DOCUMENTS

| | | | |
|---|---|---|---|
| 2,999,062 | 9/1961 | Henderson | 208/103 |
| 3,159,564 | 12/1964 | Kelley et al. | 208/59 |
| 3,779,897 | 12/1973 | Wrenchet et al. | 208/59 |

*Primary Examiner*—Herbert Levine
*Attorney, Agent, or Firm*—Millen & White

[57] ABSTRACT

Process for hydrocracking a petroleum hydrocarbon charge contaminated with nitrogenous compounds, comprising the hydrogenation of said charge in a first reaction zone followed with a separation in two phases, gaseous and liquid, of the resulting hydrogenated product, adding to said liquid phase the effluent from a subsequent prefractionation zone, treating the resulting mixture in a second reaction zone, adding to the effluent of said second reaction zone the above-mentioned gaseous phase, treating the resulting effluent in said prefractionation zone and separating therefrom a liquid fraction, at least one portion of which is recycled to said second reaction zone and a gaseous fraction which, after cooling is separated into a gas of high hydrogen content and a liquid effluent containing products converted in at least one reaction zone, said products being separated by fractionation.

12 Claims, 2 Drawing Figures

HYDROCRACKING PROCESS

Figure 1:
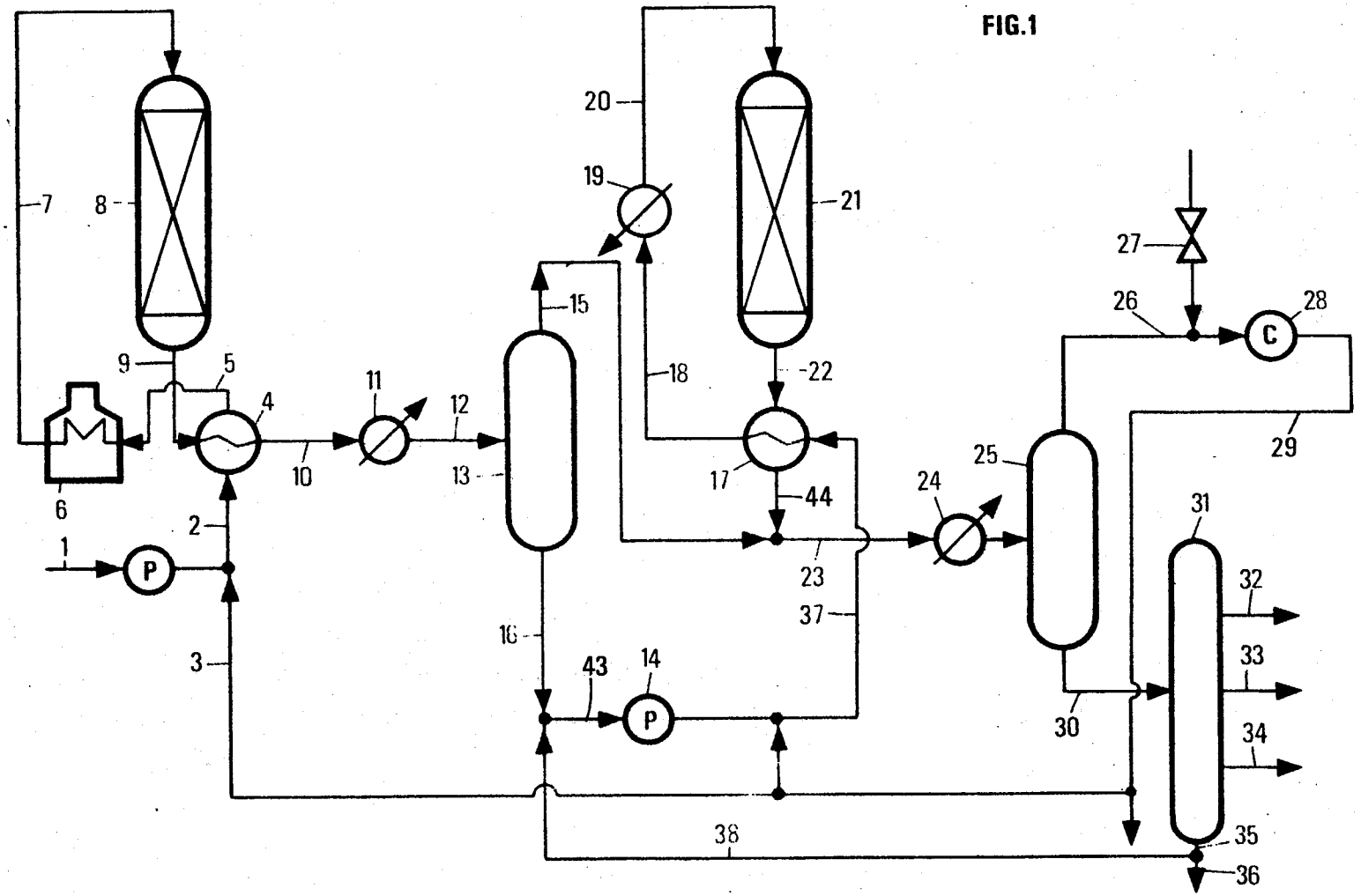

The invention concerns the hydrocracking of middle or high boiling hydrocarbon oils, under a superatmospheric pressure, at high temperature, in the presence of hydrogen and of a solid hydrocracking catalyst, so as to obtain more volatile products, particularly gasoline.

The hydrocracking process is performed in the presence of hydrogen, under relatively high pressure and at a sufficient temperature to crack the large hydrocarbon molecules contained in the charge, to hydrocarbons of lower molecular weight, boiling within the gasolinne boiling range, and in the presence of a catalyst capable to hydrogenate the unsaturated compounds which are formed during the cracking step of the process.

As examples of convenient hydrocarbon charges which can be treated according to the present invention, there will be mentioned atmospheric or vacuum gas-oils, straight run distillation cuts, or cracked products, heavy recycled products, deasphalted vacuum residues, i.e. hydrocarbons of an initial boiling point higher than about 300° C and, particularly, in the boiling range from, for example, about 340° to 600° C.

It will be noted that the hydrocarbon charges generally contain nitrogenous compounds at concentrations up to several thousands ppm (parts of nitrogen per million of parts of charge). The hydrocracking catalyst used in this invention contains at least two essential components, one of which performs the hydrogenation step of the reaction and consists of at least one metal, the other performing the cracking itself, and consisting of a substance having an acid effect, which substance may be either halogen or the catalyst carrier itself on which is deposited the hydrogenating component. The hydrogenating component of the catalyst is generally selected from at least one metal from the elements of the groups VI B and VIII of the periodical table of the elements, in the form of the free metal or of an oxide or sulfide thereof.

As metals, there can be mentioned cobalt, nickel, iron, chromium, molybdenum, tungsten, palladium, platinum, ruthenium, rhodium, osmium, iridium of mixtures of two, three or more of these metals, for example molybdenum-palladium, molybdenum-platinum, molybdenum-nickel, nickel-chromium couples or groups of three metals like nickel-palladium-molybdenum, nickel-cobalt-molybdenum, etc... The catalysts containing a noble metal of the platinum family (platinum, palladium, iridium, rhodium, osmium, ruthenium) may advantageously contain up to about 10% by weight of combined halogen, for example fluorine or chlorine, used as acid component of the catalytic composition.

Irrespective of the use of one or more catalytically active components, the latter are generally employed in the form of a composite product formed with a convenient solid carrier which may be a natural product or a synthesis product. Examples of such carriers are aluminum silicates or aluminosilicates either or not treated by acids in order to increase their activity, various clays containing alumina, sands, earths, etc... It is worth to mention the mixtures of silica and alumina, zirconia, magnesia, thorium oxide, boron oxide, titanium oxide, strontium oxide, aluminas, zirconia-aluminas, zirconia-silicas, zirconia-alumina-silicas, magnesia-silicas, mordenites, etc...

There can also be used, and this was usual during the last few years, catalysts based on zeolites or molecular sieves of the X or y type, or also of the ZMS-5, ZMS-4, types, etc...

The methods for manufacturing the hydrocracking catalysts are well-known and need not to be described here.

Generally, the operating conditions in the hydrocracking reactions depend on the various physical and chemical characteristics of the hydrocarbons of the charge.

They also depend on the nature of the catalyst used.

The process of the invention is performed at reaction temperatures from about 300° to 550° C, preferably from 300° to 500° C under pressures from 15 to 250 atmospheres, preferably from 50 to 250 atm., the higher pressures apparently favoring the destruction of all remaining nitrogenous compounds and the conversion of the hydrocarbons boiling above about 300° C.

Usually the space velocity will be from about 0.3 to 15 (preferably from 0.3 to 3) volumes of liquid charge per volume of catalyst and per hour.

The presence of nitrogenous compounds in the charge subjected to hydrocracking reactions, often creates problems. As a matter of fact, it is known that charges contain contaminating agents including nitrogen have the effects of deactivating the cracking and hydrogenating components of the hydrocracking catalyst. This results in the need to proceed at high temperatures, favoring the denitrification of the charge before its conversion. In addition, the use of such high temperatures leads to the formation of undesirable light hydrocarbons such as methane, ethane and, depending on the case, propane and butane. Moreover the use of high temperatures is not economical. On the other hand, it is not always possible or appropriate to proceed the preliminary treatments of the charge in order to remove at least the major part of the nitrogenous compounds therefrom. In addition, such elimination of nitrogenous compounds results in the formation of ammonia which also has noxious effects on the hydrocracking catalyst, so that it is then convenient to remove the produced ammonia, for example by washing the hydrocracking effluent counter-currently with a stream of an aqueous acid such as dilute hydrochloric or sulfuric acid, in a washing tower, so as to neutralize the ammonia, or to remove the ammonia by countercurrently passing a light and inert gas through the liquid phase obtained by condensation of the hydro-cracking effluent, at a sufficient velocity to vaporize (or strip) the ammonia.

All of these processes require rather time-consuming manipulations. It is known that usually, in a hydrocracking charge, the nitrogen containing compounds such as amines, indoles, pyrroles and other nitrogenous organic compounds, quickly deactivate the conventional catalysts used for hydrocracking.

Recently, there has been proposed processes making use of catalysts considered as insensitive to ammonia, some of these catalysts being for example of the zeolite or molecular sieve type. One of these processes consists of subjecting the charge to a first treatment in a first reaction zone in the presence of a conventional desulfurizing-denitrifying catalyst, or of a hydrocracking catalyst having a desulfurizing and denitrifying action on the charge, and then, in a second reaction zone, to proceed the presence of a hydrocracking catalyst insensitive to ammonia.

According to the present invention, it has been discovered a process producing excellent yields for the hydrocracking reactions by proceeding in two reaction steps, the second step of which is performed in the presence of a conventional catalyst, even of a type which is sensitive to ammonia.

The present invention has mainly for object to provide a hydrocracking process which substantially increases the yield of hydrocarbons boiling in the gasoline range, while avoiding the disadvantages resulting from the nitrogenous impurities of the charge.

According to this invention, a petroleum hydrocarbon charge, contaminated with nitrogenous compounds, is reacted with hydrogen, in a first reaction zone, at a temperature from 300° to 550° C, preferably from 300° to 500° C, under a pressure from 15 to 250 atmospheres, preferably from 50 to 250 atmospheres, in the presence of a conventional denitrification, desulfurization and/or hydrocracking catalyst containing, for example, at least one hydrogenating metal deposited on a carrier, so as to substantially denitrify the charge (nitrogen contained in the charge in the form of nitrogenous compounds is converted to ammonia which, in turn, is removed, as below indicated) and obtain an effluent which is supplied to a first hot separation zone at a pressure similar to the pressure of the first reaction zone and at a temperature from 200° to 300° C and preferably from 250° to 290° C, from which is separated on the one hand a vapor fraction in which the ammonia formed during the denitrification reaction of the nitrogenuous products contained in the charge is present in a concentrated state, said vapor fraction containing the major portion of the products converted in the first reaction zone, and, on the other hand, a liquid effluent whose ammonia content, at this stage, must be lower than 50 parts per million of parts by weight of said effluent, effluent to which is added at least one portion of the liquid bottom effluent from a prefractionation zone which will be defined hereinafter (this is a liquid fraction recycling the products which have not been converted during their passage through the second step of reaction as defined below), the resulting mixture of the liquid effluent of the first separation zone with the bottom effluent being supplied to a second reaction zone where it is contacted with a conventional hydrocracking catalyst in the presence of hydrogen, at a temperature from 300° to 550° C, preferably from 300° to 500° C, and under a pressure from 15 to 250 atmospheres, preferably from 50 to 250 atmospheres, the new resulting effluent obtained at the outlet from the second reaction zone being admixed with the vapor fraction withdrawn from the first hot separation zone and then the effluent from the second reaction zone being treated in a specific manner, indicated below, so as to recover, on the one hand, the desired products and, on the other hand, the heavy products which are recycled to at least one of the two reactors.

FIG. 1 illustrates one embodiment of the present invention. For sake of simplicity, various arrangements which are not essential for the understanding of the invention have been omitted on this figure (and also on FIG. 2). The charge of hydrocarbons spoiled with nitrogenous compounds whose content may reach 5000 parts per million or more, or also with sulfurous compounds, is fed through line 1 and pump P to line 2 where hydrogen is supplied through line 3 (on the drawing, it is recycled hydrogen, but fresh hydrogen may also be introduced through a duct not shown on the figure). The mixture of hydrogen and charge is passed through the heater 4 and supplied, through line 5, to the furnace 6, from where it is conveyed, through line 7, to the first reaction zone or reactor 8. This reactor contains one or more beds of hydrocracking catalyst used as fixed, fluid or moving beds, the reactor, of the axial or radial type for example, being itself optionally subdivided in several reaction zones in series or in parallel, superimposed or arranged side by side. Usually, in this reactor 8, the nitrogenous compounds are converted to ammonia which evolves and the sulfur containing compounds are converted to hydrogen sulfide; in addition, heavy hydrocarbons begin to be converted to light hydrocarbons, with the production, in particular, of light paraffinic hydrocarbons.

The effluent from reactor 8 is withdrawn through line 9 and conveyed to a hot separator 13, through ducts 10 and 12, after passage through exchanger 4 and heater 11, this heater being used for producing steam for energizing recycle cmpressors. From hot separator 13 which consists of any suitable device capable to separate a liquid from a gas, there is withdrawn, through line 15, a gaseous phase which contains, in particular, light hydrocarbons and ammonia, and through duct 16, heavy hydrocarbons which are admixed with at least one portion of the residue from later fractionations, said residue being supplied through duct 38; this mixture is fed, through duct 43, pumping zone 14 and duct 37, to exchanger 17 and then to exchanger or furnace 19 through duct 18, then it is introduced through duct 20 into the second hydrocracking reaction zone or reactor 21, of radial or axial type for example, which contains a fixed, fluid or moving bed catalyst, the reactor being optionally subdivided in several reaction zones in series or in parallel, superimposed or placed side by side.

The effluent withdrawn from reactor 21 is conveyed through duct 22 to exchanger 17 from which it is withdrawn through duct 44 and admixed with the gaseous stream issued, through duct 15, from separator 13.

Generally, the catalyst from either the first or the second reaction zone contains from 0.5 to 15% b.w. of at least one metal from group VI B or VIII, except in the case of a noble metal of the platinum family, for which the metal concentration is from about 0.05 to 4% b.w.

In the first and the second reaction zones, the temperature is usually from 300° to 470° C, particularly from 350° to 450° C and the pressure is usually from 65 to 170 atmospheres. The hydrogen amount is from about 150 to 1000 normal liters per liter of charge in the first reaction zone and from about 500 to 1500 normal liters per liter of charge in the second reaction zone.

In the first reaction zone, the hourly space velocity is preferably from 0.3 to 3 volumes of liquid charge per volume of catalyst per hour and in the second reaction zone it is preferably from 0.5 to 2 volumes of liquid charge per volume of catalyst per hour.

In the process of the invention, it is essential to reduce the ammonia content of the effluent fed to the second reaction zone to a relatively low value, lower than about 50 ppm, in order to maintain over long periods the hydrocracking activity of the catalyst in said second reaction zone. It results that, in view of the almost negligible concentration of nitrogenous compound in the charge of the second reaction zone, it is possible to proceed, in said second reaction zone, under less severe conditions than usually, for example at a temperature from 30° to 100° C and preferably from 50° to 95° C below the temperature in the first reaction zone (i.e. for example, at a temperature from about 300° to 440° C or, even preferably, from 300° to 370° C), and at substantially similar space velocities of about 0.3 to 5 or 0.5 to 2 volumes of liquid charge per volume of catalyst and per hour in spite of the high conversion rate achieved. When operating under milder conditions, it is further possible to extend the life-time of the obtained catalyst.

A hydrocracking process, as above described, thus provides a very substantial improvement of the technology. The process of the invention results in the production of large amounts of hydrocarbons boiling in the gasoline range, from heavy fractions.

The presence of the first reactor where takes place a non negligible prior conversion and the subsequent elimination of light hydrocarbons from the effluent feeding the second reactor, results in the production of gasolines at an optimum rate in the second reactor and in higher yields; in the prior art processes, the effluent from a first hydrocracking reactor is generally subjected at this stage to a fractionation, the heavy product obtained from this fractionation being sent to a second reactor. In the present process, the second reactor is fed not only with the heavy product obtained during later fractionations of the effluent from said second reactor, but also with the liquid effluent withdrawn from the first reactor. Accordingly, the liquid effluent from the first reactor is already subjected to a preliminary conversion in the second reactor which will decrease the amount of heavy residue recycled to this second reactor. Otherwise stated, the unconverted products from the first reactor are already subjected to a partial conversion in the second reactor before being introduced in said second reactor after their withdrawal from the bottom of a subsequent fractionation zone following said second reactor. As the products issued from the first reactor contain ammonia (formed in the first reactor by conversion of the nitrogenous compounds contained in the charge), which is detrimental to a conventional hydrocracking catalyst, as may be used in the second reactor, the process of the invention provides for the removal of an ammonia vapor fraction and the introduction in the second reactor of a liquid phase substantially free of nitrogenous compounds and ammonia, the ammonia being subsequently removed after said second step by precipitation in the form of ammonium sulfide obtained in particular by reaction with hydrogen sulfide also contained in the final reaction effluent from the second reactor.

The hot separator 13, following the first reactor, provides a liquid effluent which is deemed to contain no more than about 50 ppm of nitrogenous compounds, which is the maximum acceptable concentration for acceptable performance of the catalyst used in said second reactor; the process offers the advantage that the vapor phase withdrawn from separator 13 contains, as a result of the use of a hot separator, the major part of the products converted in the first reaction zone and, particularly, LPG and gasoline; these products, in view of the fact that they do not pass through the second reactor, since the vapor phase from the hot reactor by-passes the second reactor, do not unusefully exhaust the capacity of the catalyst of the second reactor to crack these LPG; the catalyst of the second reactor thus maintains its complete capacity to hydrocrack the heavier fractions from the first reactor and from the bottom of the subsequent fractionation colomn following said second reactor. The present invention also provides for the optional provision of a recycling pump or compressor 14 on FIG. 1 at the bottom of the hot separator vessel 13, whereby the $\Delta P$ (pressure difference) of the recycle compressor may be optimized. It results that, by means of said pump 14, it is possible to reduce or avoid the pressure drop generated in the second reactor which, as an average, amounts to 4 to 6 atmospheres, and also the pressure drop due to thermal equipments associated to said second reactor.

Ths optimization has for object to reduce the power consumed by the recycle compresor and thereby to improve the power requirement of the process; the separating vessel 13 and the intersection of lines 15 and 44, after the second reactor, being substantially at the same pressure, the operating conditions are the same for the compressor, as far as the pressure difference is concerned, as if the second reactor and its associated equipments were omitted. In separator 13, the regulation of the vapor-liquid separation, necessary to the improvement of the separation of ammonia gas, is performed by adjusting the temperature of this separating vessel 13 by means of the boiler 11 which, in addition, produces the steam required for energizing the recycling compressor 14, this boiler 11 having the further advantage to avoid the use of any device of the valve type in the circuit. It is further possible to adjust the temperature of the separating zone 13 by controlling all thermal exchanges upstream and particularly a boiler by adjusting its liquid level, which avoids the need of a regulation valve on the reaction circuit. With reference to FIG. 1, it must be noted that a second recovery boiler 24 may be placed between exchanger 17 and the subsequent system for separating the effluent of the second reactor, in order to recover the vapor present in the circuit from the effluents of the second reactor.

The process of the invention, as above-described, which is already satisfactory, becomes highly competitive when it is associated to a subsequent system for fractionation of the effluent from the second reactor, which will be described hereinafter:

As a matter of fact, when the processes of the prior art are performed in one or in several steps (one or more reactors) with catalysts which are or not sensitive to nitrogen, various fractionation processes of a hydrocracking effluent can be used. For example, there will be mentioned the following hydrocracking processes:

A first process consists of treating the charge under high pressure, for example, from 100 to 150 atmospheres in a reactor which may contain several catalyst beds, the catalysts of these beds being identical or different, and feeding the resulting effluent to a separating vessel operated under "high pressure", i.e. under a pressure similar to that of the reactor from which it is withdrawn; In that separating vessel it is withdrawn, on the one hand a vapor fraction containing hydrogen, advantageously recycled to the reactor and, on the other hand, a liquid effluent which is fed to a separating vessel operated at "low pressure" i.e. at a pressure substantially lower than that prevailing in the so-called "high pressure" reactor (for example, a pressure of about 20 atmospheres) from which it is generally withdrawn, on the one hand, and according to the type of charge, hydrogen sulfide and C4− hydrocarbons, and, on the other hand, an effluent which is fed, after stripping of its lighter components, to a fractionation zone, from where it is recovered, for example, a light gasoline fraction, a heavy gasoline fraction, a kerosene fraction, a gas-oil fraction and a heavy fraction, e.g. a 350+ fraction, which at least partly, is recycled to the reactor.

Another process consists of treating the charge from the first reactor in the presence of a conventional hydrocracking catalyst, then to feed with the effluent from this first reactor a second reactor containing a hydrocracking catalyst insensitive to ammonia (formed in the first reactor by reaction of the various nitrogenous impurities usually contained in the treated charge, with hydrogen), the effluent of the second reactor being then, as in the first above-described process, fed successively to a "high-pressure" separator, then to a "low pressure" separator, before being subjected to stripping in a fractionation zone, from the bottom of which is recovered a heavy fraction (e.g. 350+) which is, at least partly, recycled to the second reactor of the process.

A third process consists of treating the charge in a first reactor containing a conventional hydrocracking catalyst, supplying the effluent thereof to a "high pressure" separator from which is withdrawn, on the one hand, a hydrogen containing gas which is recycled, at least partly, to the first reactor and/or to the second reactor as defined below, and, on the other hand, an effluent which is fed to a "low pressure" separator and, after optional passage through a stripping zone, to a fractionation unit from where are recovered various fractions as final products, and a bottom fraction which is fed, at least partly, to a second reactor containing at least one conventional hydrocracking catalyst bed, the effluent from said second reactor being fed, jointly with the effluent of the first reactor, to a "high pressure " separator.

In the flow sheet of FIG. 1, concerning the arrangement, according to the invention, of two reactors, it is possible to conventionally treat the charge issued from the second reactor 21 in the following manner (see FIG. 1 on which the path followed by the effluent of the second reactor, after duct 23, is not in conformity with the invention):

The effluent withdrawn from reactor 21 is fed through duct 22 to an exchanger 17 from which it is withdrawn through duct 44 and admixed with the gas stream issued from duct 15 of separator 13 (the resulting mixture is generally cooled so that, at a later stage, when the temperature of the mixture will be dropped to about 60° to 100° C, the nitrogenous volatile products, particularly ammonia, will be converted in major part to stable ammonium sulfides by reaction, for example, with hydrogen sulfide from the vapor phase withdrawn from separator 13. These ammonium sulfides are removed from the ducts through any known means. Generally, ammonium sulfide is formed after the boiler 24 and before the final cooler, not shown on the figure, which is upstream the last separator 25 as hereunder defined. The mixture of the liquid effluent from the second reactor and of the vapor fraction issued from separator 13 is conveyed, through duct 23, to the steam-producing boiler 24, then to separtor 25 operated under high pressure and low temperature; from the separator 25, there is separated, on the one hand, a gas of high hydrogen content which is recycled at least partly to reactors 8 and 21 through duct 26, compressor 28 and duct 29. The second reactor may also be fed, if necessary, in totality or partly, with fresh hydrogen. Additional hydrogen may be introduced into the system through duct 27. Recycled hydrogen may optionally, in totality or partly, be fed also to reactor 8.

The liquid fraction withdrawn from separator 25 is introduced through duct 30 into the fractionation apparatus 31. This fractionation apparatus 31 is operated under any convenient temperature and pressure conditions adapted to the obtainment of the desired products and gasolines through ducts such as 32, 33 and 34, with the obtainment, at the column bottom, of unconverted heavy products of the "heavy ends" type, which are withdrawn through duct 35 and at least partly recycled through duct 38 to the second reactor 21, after preliminary reheating to the temperature of reactor 21 and recompression to the pressure prevailing in reactor 21, by means of convenient devices, not shown on FIG. 1.

All of these processes as well as other hydrocracking processes not described here, comprise the recycling to at least one of the reactors of the system, of a bottom fraction from a zone for fractionating the main effluent of the reactors, zone from which various cuts have been separated as final products.

Before said main effluent is introduced into the fractionation zone, it is generally passed through at least two separating vessels in order to remove the gaseous fractions thereof. At the outlet from the fractionation zone, the bottom fraction from said fractionation zone, which is destined at least partly to be recycled to one of the reactors, is at a low pressure as compared to the pressure prevailing in the reactor to which it is to be recycled.

It is thus necessary to conveniently pressurize this bottom fraction, and this is a very expensive operation in view of the considerable consumption of electric power or of other utilities which may be presently considered as a "wasting" in view of the particular economic conditions.

The present invention substantially avoids these drawbacks.

It is characterized by the particular arrangement of two reactors as above explained and it is further characterized in that the effluent from the second reaction zone is fed (through duct 23 of FIG. 1), in admixture with the vapor fraction (duct 15 of FIG. 1) withdrawn from the first separation zone (13 on FIG. 1) to a so-called pre-fractionation zone operated under a pressure substantially similar to that prevailing in the reaction zone from which this effluent has been withdrawn, said prefractionation comprising separating by stripping with a gas, e.g. additional hydrogen from the unit of recycled hydrogen or a mixture of fresh hydrogen and recycled hydrogen (said hydrogen according to its origin being either pure or impure, and in the latter case, containing inert gases, nitrogen or hydrocarbon gases such as methane, ethane, propane, butane; said hydrogen has been compressed to the pressure required for the unit and is delivered at the last stage of the compressor without subsequent refrigeration i.e. at a temperature from 100° to 150° C according to the delivery pressure), the liquid and gaseous phases from said effluent to obtain, on the one hand, at the top of the prefractionation zone, a gaseous fraction containing, in particular, hydrogen and the major part of the products converted in at least one reaction zone from which is issued said effluent and, on the other hand, at the bottom of the prefractionation zone, a fraction of heavy or unconverted products, at least one part of which is recycled to at least the reaction zone from where said effluent has been withdrawn, the gaseous fraction withdrawn from the top of said prefractionation zone being fed, after cooling thereof, to a separation zone from which there is recovered, on the one hand, a gas particularly of high hydrogen content which may be optionally recycled at least partly to at least the prefractionation zone as stripping agent and, optionally, also to at least one of the reaction zones of the process, and on the other hand, a new liquid effluent which is fed to a fractionation zone in order to separate the desired cuts as final products.

The bottom product from said fractionation zone may, if so desired, be recycled at least partly to at least one of the reaction zones. Generally, the so-called prefractionation zone is a stripping column comprising several plates, for example three, four or five, and in which the reaction effluent is introduced on one of the upper plates and the stripping gas under the lower plate.

Accordingly, in the process of the invention, the unconverted heavy products of the reaction effluent which thus have to be recycled to at least the reactor from which originates the reaction effluent, will be partially separated from the gaseous products and the converted products also contained in the reaction effluent, this separation being performed in a prefractionation column operated substantially under the same pressure as that prevailing in the reactor into which the unconverted heavy products will be recycled (it must be noted that the temperature of the prefractionation column, although not so high than the reactor temperature, is still substantially high. For example, it has been observed that the temperature of the second reactor was 30° to 100° C lower than the temperature of the first reactor, said temperature of the second reactor being, for example, from about 300° to 440° C so that the temperature of introduction of the reaction effluent entering the prefractionation column could be advantageously from 100° to 400° C, preferably from 200 to 380° C). It follows that, contrarily to the prior art processes, a substantial portion of the heavy fraction to be recycled after separation thereof from the gaseous products and converted products, is always substantially under the pressure conditions prevailing in the reactor to which this fraction will be recycled (this heavy fraction is also at a relatively high temperature which, in some cases, may even be only slightly lower than the temperature of the reactor where this fraction will be recycled). Thus by the process of the invention, it is possible to avoid the huge power consumption which, according to the prior art, were always necessary when recycling an unconverted fraction to a reactor since, according to the prior art, the heavy fraction, when separated, at the end of the circuit, from the bottom of the separation zone by fractionation, was at low pressure as compared to that prevailing in the reaction zone and, accordingly, required a substantial pressurization.

Figure 2:
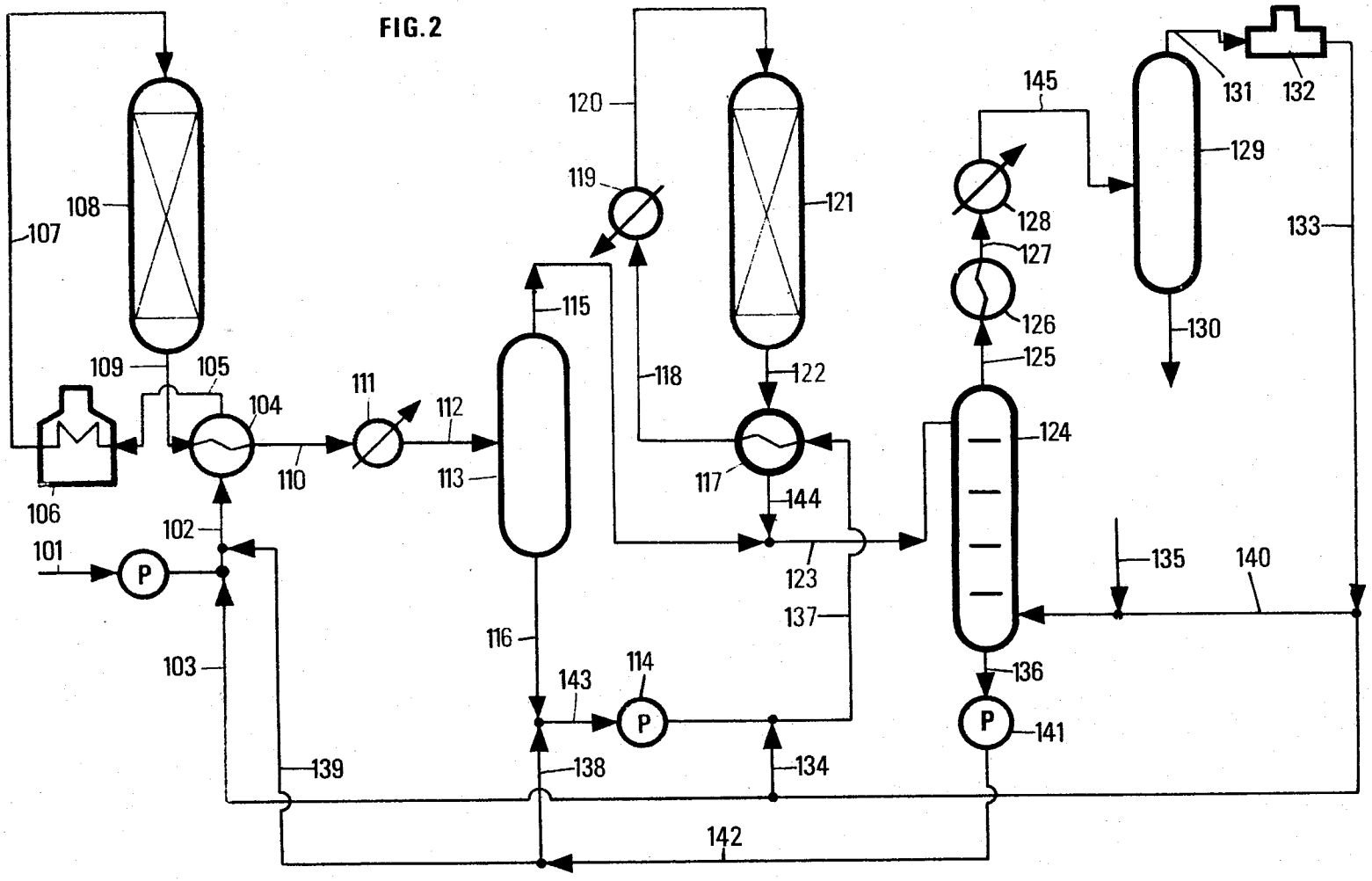

FIG. 2, in conformity with the invention, shows, on the one hand, a particular hydrocracking process of the invention whereby it is possible, in particular, to proceed with conventional hydrocracking catalysts even when the charge is contaminated with nitrogen and sulfur compounds and, on the other hand, illustrates the arrangement for the treatment of the reaction effluents, in accordance with the process of the invention, as applied to this particular hydrocracking process.

On FIG. 2, in conformity with the process of the invention, the path followed by the charge, and then by the effluents from the two reactors, is the same as in FIG. 1 up to the passage through exchanger 17 (117 on FIG. 2). Thus, a mixture of the charge introduced through duct 101 and pump P with hydrogen introduced through duct 103, is fed through duct 102, exchanger 104, duct 105, furnace 106 and duct 107, to reactor 108 and, from there, through duct 109, exchanger 104, duct 110, boiler 111 and duct 112, to the separator 113. The gaseous effluent is withdrawn through duct 115 and the liquid effluent through duct 116. The liquid effluent, passing through duct 143, pump 114 and line 137, reaches exchanger 117 and, through ducts 118 and 120, after passage through exchanger or furnace 119, is fed to the second reactor 121. The effluent from said second reactor, withdrawn through duct 122, passes through exchanger 177, then through duct 144 and is admixed with a gaseous effluent issued through duct 114 from separator 113; according to the process of the invention, the mixture of the gaseous effluent from duct 115 with the liquid effluent from duct 144 is conveyed through line 123 to the top of a prefractionation column 124 which, in the case of FIG. 2, comprises four plates.

In said prefractionation column 124, said mixture is subjected to a first fractionation favored by stripping with hydrogen introduced through duct 140 (recycled hydrogen) and/or through duct 135 (additional hydrogen). The prefractionation column 124 is operated at substantially the same pressure as that prevailing in reactor 121. From the bottom of the prefractionation column, there is withdrawn, through duct 136 and pump 141, an effluent of unconverted heavy products which may be recycled as such, at least partly, to reactors 108 or 121, through lines 142, 138 and/or 139. From the top of the prefractionation column 124, there is withdrawn a gaseous fraction which passes through duct 125, exchanger 126, duct 127, and is supplied to a final cooler 128, then it is conveyed, through duct 145, to a separator 129, operated under high pressure and low temperature and, from which it is withdrawn, through duct 130, a liquid effluent which is fed to a fractionation unit, not shown in FIG. 2, in order to recover various cuts, as final products, as well as a bottom residue; this residue may be fed back to reactors 108 and/or 121, in a conventional manner, through pumps. However, it has also been found that this bottom residue could be fed back, in admixture with the charge, exclusively to the first reactor; as a matter of fact, by adjustment of the operating conditions of the prefractionation column, it is possible to reduce the recycling of unconverted products from the fractionation section to a very low value which does not justify their direct recycling to the second state reactor; in these conditions, only the bottom product from the prefractionation column is recycled to the second reactor (reactor 121 on FIG. 2) while the recycled products issued from the fractionation section, not shown on FIG. 2, is admixed with the feed charge of the unit and thus passes through both reactors 108 and 121. This provision has the advantage of eliminating the need of the pump for recycling at a high manometric height while having substantially no effect on the selectivity of the process, the fraction recycled to the first step reactor being low.

From the separator 129, there is also withdrawn a new vapor fraction containing particularly hydrogen, which may be recycled through duct 131, compressor 132 and ducts 133, 103 and 134, to reactors 108 and 121, and, optionally, through ducts 133 and 140 to the prefractionation column where it can be used in addition to fresh hydrogen (introduced through line 135) as stripping gas.

The hydrogen from duct 131 has been recompressed in compressor 132, the hydrogen flow rate in each branch of the circuit leading to reactors 108 and 121 and to the prefractionation column 124 being controlled by convenient means, for example by control valves.

The advantage of the arrangement of FIG. 2 as compared to that of FIG. 1, consists in the replacement of a separator by a prefractionation column, operated under pressure conditions similar to those of the reactor from which originates the effluent feeding this column, provided with only a few plates, in which said effluent is subjected to a stripping with hydrogen and is very satisfactorily separated into a gaseous phase and a liquid phase, the latter phase containing the major portion of the unconverted products, these unconverted products being optionally recycled directly to the reactor since they are still at the same pressure as that prevailing in this reactor and at a relatively close temperature. It is appreciated here that a considerable advantage is obtained according to the invention whereby at least one portion (generally a substantial one) of the unconverted heavy fraction may be recycled as such while, for example, in the case of FIG. 1, the heavy fraction is obtained at the bottom of a conventional fractionation column under a relatively low pressure (maximum pressure of a few atmospheres) so that, before recycling the heavy fraction to a reactor, it is necessary to increase its pressure substantially.

In addition, in the arrangement diagrammatically shown in FIG. 1, a temperature of 300° - 350° C is obtained at the bottom of the conventional fractionation column 31, so that it is necessary to reheat this entire heavy fraction from the temperature (40° to 60° C) of the separator 25 of reactor 21 from which said heavy fraction issues, up to a temperature of 300° - 350° C, prevailing at the bottom of the fractionation column 31; accordingly, the use of the present process of the invention results in a significant saving of fuel and electric power required for heating and pressurizing the heavy fraction. Another advantage of the process results from the fact that the separation of at least a portion of the heavy fraction to be recycled has been achieved in the prefractionation column, and accordingly, the fractionation device (not shown on FIG. 2), required for the separation of the cuts desired as final products, may be substantially reduced in size, as compared to the fractionation devices generally used in the prior art, since the charge of the fractionation unit boils within a noticeably narrower range than in the case of the prior art (since this charge contains substantially less heavy products).

It will be mentioned that In the process of the invention, the loss of hydrogen by dissolution, in the liquid phases of the prefractionation column (124 on FIG. 2) and of the separator vessel (129 on FIG. 2)) is smaller than in a unit equipped with a single cold separator vessel, in view of the recycling to the reactors of the bottom product from the prefractionation column, which is the main factor of the hydrogen losses by dissolution. Thus, in the present process, hydrogen dissolved in the bottom of the prefractionation column is not lost.

The process of the invention is particularly convenient for hydrocracking charges consisting of not too heavy fractions, resulting in the formation, in the bottom of said prefractionation zone, of a liquid effluent (bottom product) the major part of which (about 85 to 97% b.w.) has an initial distillation point from about 160° to 200° C, for example close to 180° C.

The following examples 1 (comparative) and 2 illustrate the invention.

EXAMPLE 1 (comparative)

This example illustrates a hydrocracking process performed with an arrangement of two reactors according to the invention, i.e. with "by-pass" of the gaseous fraction of the first reactor. However, the fractionation of the effluent from the second reactor is not performed according to the process of the invention. The hydrocracking process is applied to a charge of hydrocarbons boiling in the range of the vacuum distillates and originating from the following crude oils admixed in the proportion indicated in the following table, in order to obtain a maximum conversion to gasoline having a final boiling lower than 175° C TBP.

50% b.w. light Arabian
25% Zarzaitine
12.5% Arzew
12.5% Hassi Messaoud
Specific gravity d 20/4:0.896
Viscosity at 210° F:5.5 to 6 Cst
Sulfur content:1.2% b.w.
Nitrogen content:400 ppm The charge, admixed with recycled gas and additional fresh gas, is treated in a first reaction step for sulfur and nitrogen removal; a slight conversion of hydrocarbons also takes place. The operating conditions in this first step are as follows:

Space velocity:1 liter of charge per liter of catalyst
Pressure of 150 bars at the reactor inlet
Maximum outlet temperature:460° C.

Under these operating conditions, the conversion products are obtained with the following yields:

| Substances | Yields by weight % of the charge |
|---|---|
| $H_2S + NH_3$ | 1.32 |
| $C_4$ and lighter ($C_4^-$) | 3.40 |
| Gasoline $C_5$ - 175° C TBP | 22.60 |
| Products boiling above 175° C TBP | 74.48 |
| Total | 101.80 |

The reaction effluent from the first step is then cooled to a temperature of 250° C by heat exchange with the feed charge of the first reactor and in a boiler producing steam used for energizing the turbine driving the recycling compressor. The temperature of 250° C is controlled by adjusting the amount of steam produced by this recovering boiler.

The temperature of 250° C once obtained, the reaction effluent of the first step is fed to a separator vessel in which said effluent is separated into a liquid and a gaseous phases. The liquid phase, in admixture with recycled unconverted heavy products fractionated by distillation hereunder defined, is fed to the second step reactor and the vapor phase by-passes said reactor.

The distribution of the conversion products, obtained in the first step after deduction of the amounts recycled through the recycling gas, between the liquid and vapor phases of said separator vessel, is reported below:

| Products | Distribution % by weight | |
|---|---|---|
| | Vapor phases | Liquid phases |
| $NH_3$ | 99 | 1 |
| $H_2S$ | 86.5 | 13.5 |
| $C_4$ and lighter ($C_4^-$) | 70 | 30 |
| Gasoline $C_5$ - 175° C TBP | 67 | 33 |
| Products boiling above 175° C TBP, and below the boiling point of the feed charge | 18 | 82 |
| Products boiling above the final boiling point of the feed charge | 0.2 | 99.8 |
| Ammonia concentration of the liquid phase | | 20 ppm. |

The liquid phase from the separator vessel, admixed to the recycled heavy products, equivalent to 58.5% by weight of the initial fresh charge, is treated in a secnd step reactor operated under the following conditions : space velocity : 1 liter of total charge per liter of catalyst, pressure at the inlet of the reactor : 150 bars, maximum temperature at the outlet of the reactor : 365° C. The yields per run of conversion products are higher than those of the first step.

| Substances | Total conversion yields, expressed in % b.w., of 100 kg of unconverted products of the first step |
|---|---|
| $H_2S + NH_3$ | 0.00 |
| $CH_4$ and lighter ($C_4^-$) | 14.96 |
| Gasoline $C_5$ - 175° C TBP | 86.88 |
| Total | 101.84 |

It results the following total yields at the outlet of the two steps:

| Substances | Yields in % of the initial fresh charge |
|---|---|
| $H_2S + NH_3$ | 1.32 |
| $C_4$ and lighter ($C_4^-$) | 14.55 |
| Gasoline $C_5$ - 175° C TBP | 87.30 |
| Total | 103.17 |

The effluent of the reactor of the second step preheats successively this reactor feed and the feed of the first step reactor. It is then admixed with the vapor phase issued from the intermediates separator vessel, the whole being then cooled down to a temperature of 45° C in an air cooler before being introduced into a second separator vessel. The vapor phase from said separator vessel is entirely recycled to both reactors and the fresh feed gas of the unit is beforehand added thereto. The liquid phase, after expansion in a second separator vessel calibrated at a pressure of 20 bars, is, after stripping, fractionated in an atmospheric distillation column. The petroleum fractions which have not been converted, during their passage on the second step reactor catalyst, to products of boiling point lower than or equal to 175° C, are withdrawn from the bottom of the atmospheric distillation column to be recycled to the second step reactor.

EXAMPLE 2

The preceding example is repeated with the incorporation, in the reaction loop, after the two reactors, of the prefractionation column. All the process of this example 2 is preformed in accordance with the invention.

The effluent from the second reactor preheats, as previously indicated, the feed of this reactor. It is then passed through a recovery boiler where, by adjusting the amount of steam produced, the temperature at which the reaction effluent will be introduced into the prefractionation column is adjusted to 250° C. The total amount of fresh gas for the unit is introduced at the bottom of said prefractionation column at a temperature of 150° C. Its composition is as follows:

| Additional fresh gas Components | Concentrations % volume |
|---|---|
| Hydrogen | 95 |
| Hydrocarbons | 5 |

The bottom product from the fractionation column is directly recycled to the suction inlet of the pump feeding the second step. The bottom product has substantially the following composition by weight:

| Substances | |
|---|---|
| $C_4$ and lighters ($C_4^-$) | 0.3 |
| Gasoline cut $C_5$ - final boiling point TBP 175° C | 4.7 |
| Products boiling above 175° C | 95.0 |
| | 100.0 |

It appears in the present case that the initial distillation point of the major part of this bottom product is 175° C.

The vapor phase discharge from said column contains the major part of the products converted in both steps. This vapor phase to which is added the vapor phase from the intermediate separator vessel preheats the feed charge of the reactor of the first step before being finally cooled in an air cooler to a temperature of 45° C, and fed to a separator vessel.

Condensates are introduced upstream the air cooler in order to dissolve the ammonium sulfides formed by combination of hydrogen sulfide and ammonia.

The liquid phase of the separator vessel, consisting essentially of conversion products, is conveyed to the stripping and distillation columns in order to be fractionated. The vapor phase from the separator vessel is recycled to both reactors.

The incorporation of a prefractionation column to the initial diagram has the following advantages:

Direct recycling to the second step reactor of 58% of products unconverted to gasoline in this reactor. As a result of this direct recycling and in view of its light dilution with lighter products, there is obtained a saving of 5.5 kwh and of 55,000 Kcal/hour of fuel equivalent per ton of fresh charge at the inlet of the unit in the case of the considered hydrocracking unit whose characteristics are as follows:

Capacity : 1,150,000 tons/year of vacuum distillate
Total conversion to gasoline and lighter products.
Hydraulic recovery turbine not provided on the effluent liquid stream from the reaction section.

The operating conditions of the unit, particularly the partial hydrogen pressure in the reaction zone, the volume of recycled hydrogen, determined by the purity of the recycled gas, are not affected since this purity is substantially constant in both cases.

| | Hydrogen purity in the recycled gas % by volume |
|---|---|
| Conventional diagram (example 1) | 84.3 |
| Diagram with a prefractionation column (example 2) | 83 |

The hydrogen consumption of the unit is reduced since only the losses by dissolution in the liquid phase of the separator vessel, downstream the prefractionation column, must be taken into account.

| | Hydrogen losses by dissolution expressed in $m^3$ of pure $H_2$ at 15° C and one atmosphere per $m^3$ of charge at 15° C |
|---|---|
| Diagram without prefractionation column (example 1) | 30.5 |
| Diagram with prefractionation column (example 2) | 22.5 |

We claim:

1. A process for hydrocracking a petroleum hydrocarbon charge contaminated with nitrogenous compounds, in which said charge is treated in a first hydrocracking reaction zone at a temperature from about 300° to 550° C under a pressure from about 15 to 250 atmospheres, in the presence of hydrogen and of a catalyst containing at least one hydrogenating component selected from at least one metal of the groups VI B and VIII of the periodic table of the elements, in the form of the free metal or an oxide or sulfide thereof, said hydrogenating component being deposited on a solid carrier selected from a natural or a synthesis product, said process comprising the steps of feeding the effluent from the first hydrocracking reaction zone to a first separation zone whose pressure is the same as in the first hydrocracking reaction zone and whose temperature is from 200° to 300° C, separating in said separation zone (a), a vapor fraction containing, ammonia and the major part of the products converted in the first hydrocracking reaction zone and (b), a liquid effluent whose ammonia content is lower than about 50 parts by weight per million of parts of said effluent, adding to said effluent at least a portion of the liquid effluent from the bottom of a prefractionation zone as hereunder defined, feeding the resulting mixture of said liquid effluent of the first separation zone and said liquid effluent from the bottom of the prefractionation zone to a second hydrocracking reaction zone where it is heated in the presence of a catalyst containing at least one hydrogenating component selected from at least one metal of the groups VI B and VIII of the periodic table of the elements, in the form of the free metal or an oxide or sulfide thereof, said hydrogenating component being deposited on a solid carrier selected from a natural or a synthesis product, at a temperature from about 300° to 550° C under a pressure from about 15 to 250 atmospheres, admixing the new effluent obtained from the second hydrocracking reaction zone with the vapor fraction withdrawn from the first separation zone, feeding the resulting mixture of said effluent of said second hydrocracking reaction zone with said vapor fraction to a prefractionation zone operated under the same pressure as in the hydrocracking reaction zone from where said effluent has been withdrawn, separating in said prefractionation zone, by stripping with a gas as defined below, the liquid and gaseous phases of said effluent, so as to obtain, at the top of the prefractionation zone, a gaseous fraction containing mainly hydrogen and the major portion of the products converted in at least the hydrocracking reaction zone from where said effluent issues, and, at the bottom of the prefractionation zone, a fraction of heavy or uncoverted products, at least one part of which is recycled to at least the second hydrocracking reaction zone from where said effluent has been withdrawn, said gaseous fraction, withdrawn from the top of said prefractionation zone, being fed, after cooling, to a separation zone from wherein it is recovered, a gas of high hydrogen content and a new liquid effluent which is fed to a fractionation zone in order to separate the desired cuts as final products, in which process the gas used for the stripping step contains hydrogen, the said gas comprised of, at least partly, of the said gas of high hydrogen content obtained after cooling of the said gaseous fraction withdrawn from the top of the prefractionation zone of the said gas comprised of a mixture of fresh hydrogen with at least one portion of the said gas of high hydrogen content obtained after cooling of the said gaseous fraction withdrawn from the top of the prefractionation zone.

2. A process according to claim 1, in which at least a part of the said gas of high, hydrogen content is recycled to at least one of the hydrocracking reaction zones.

3. A process according to claim 1 in which at least the portion of the heavy or unconverted product fraction obtained from the bottom of said prefractionation zone which must be recycled, is exclusively recycled to said second hydrocracking reaction zone.

4. A process according to claim 1 wherein the treated charge subjected to hydrocracking consists of not too heavy fractions and the major part of the liquid effluent obtained from the bottom of the prefractionation zone has an initial distillation point from about 160° to 200° C.

5. A process according to claim 1, in which the first hydrocracking reaction is conducted at a temperature from about 300° to 500° C, under a pressure from about 50 to 250 atmospheres, the first separation is conducted at a temperature from about 250° to 290° C, and the second hydrocracking reaction at a temperature from about 300° to 500° C under a pressure from 50 to 250° atmospheres.

6. A process according to claim 5 in which the temperatures in the first and the second hydrocracking reaction zones are from about 300° to 470° C.

7. A process according to claim 5, in which the temperature in the second hydrocracking reaction zone is about 30° to 100° C below the temperature in the first hydrocracking reaction zone.

8. A process according to claim 7, in which the temperature in the second hydrocracking reaction zone is from about 300° to 440° C.

9. A process according to claim 7, in which the temperature in the second hydrocracking reaction zone is from about 320° to 370° C.

10. A process according to claim 8, in which the temperature of introduction of the effluent feeding the prefractionation column is from about 100° to 400° C.

11. A process according to claim 13, in which the temperature of introduction of the effluent feeding the prefractionation column, is from about 200° to 380° C.

12. A process for hydrocracking a petroleum hydrocarbon charge, contaminated with nitrogenous compounds, in which said charge is treated in a first hydrocracking reaction zone at a temperature from about 300° to 470° C under a pressure from about 50 to 250° atmospheres, in the presence of hydrogen and of a catalyst containing at least one hydrogenating component selected from at least one metal of the groups VI B and VII of the periodic table of the elements, in the form of the free metal or an oxide or sulfide thereof, said hydrogenating component being deposited on a solid carrier selected from a natural or a synthesis product, said process comprising the steps of feeding the effluent from the first hydrocracking reaction zone to a first separation zone, whose pressure is the same as in the first hydrocracking reaction zone and whose temperature is from 250° to 290° C, separating in said separation zone, (a) a vapor fraction containing mainly ammonia and the major portion of the products converted in the first hydrocracking reaction zone and, (b) a liquid effluent whose ammonia content is lower than about 50 parts per million of parts of said effluent by weight, adding to said effluent at least one portion of the liquid effluent from the bottom of a prefractionation ation zone a hereunder defined, feeding the resulting mixture of said liquid effluent of the first separation zone and said liquid effluent from the bottom of the prefractionation zone to a second hydrocracking reaction zone where it is treated at a temperature from about 300° to 440° C, said temperature being about 30° to 100° C below the temperature prevailing in the first hydrocracking reaction zone, in the presence of a catalyst defined as the catalyst of the first hydrocracking reaction zone, under a pressure from about 50 to 250° atmospheres, admixing the new effluent obtained at the outlet from the second hydrocracking reaction zone with the vapor fraction withdrawn from said first separation zone, feeding the resulting mixture, at a temperature from about 200° to 380° C, to a prefractionation zone operated under the same pressure as in the hydrocracking reaction zone from where said new effluent was withdrawn, separating in said prefractionation zone, by stripping with a gas containing at least a portion of recycle hydrogen, the liquid and gaseous phase of said mixture so as to obtain, at the top of the prefractionation zone, a gaseous fraction containing mainly hydrogen and the major portion of the products converted in at least the hydrocracking reaction zone from where is issued said new effluent, and, at the bottom of the prefractionation zone, a fraction of heavy or unconverted products, the major portion of which has an initial distillation point from about 160° to 200° C and at least one portion of which is recycled to the second hydrocracking reaction zone, but not to the first hydrocracking reaction zone, said gaseous fraction, withdrawn from the top of said prefractionation zone, being fed, after cooling, to a separation zone from where is recovered a gas of high hydrogen content which is at least partly recycled to the said prefractionation zone, as stripping gas, and to at least one of the two hydrocracking reaction zones and a new liquid effluent which is fed to a fractionation zone in order to obtain the cuts desired as final products, and a bottom product which is at least partially fed back with the charge to the first reaction zone.

* * * * *